United States Patent [19]

Bibeault

[11] Patent Number: 4,720,905

[45] Date of Patent: Jan. 26, 1988

[54] PIN RELEASING

[76] Inventor: Lionel J. Bibeault, 50 E. Kirkbrae Glen, Lincoln, R.I. 02865

[21] Appl. No.: 919,710

[22] Filed: Oct. 16, 1986

[51] Int. Cl.[4] ..... H01H 37/67; H01R 43/00

[52] U.S. Cl. ..... 29/446; 337/407; 439/874

[58] Field of Search ..... 339/255 R, 275 R, 275 B, 339/46, 94 A, 48, 49 B; 29/446; 439/874; 337/407, 414

[56] References Cited

U.S. PATENT DOCUMENTS

| | | | |
|---|---|---|---|
| 2,142,176 | 1/1939 | Cameron | 339/48 |
| 3,740,688 | 6/1973 | McIntosh et al. | 337/407 X |
| 3,887,257 | 6/1975 | Panek et al. | 339/49 B X |
| 4,179,679 | 12/1979 | Houghland | 337/407 |

FOREIGN PATENT DOCUMENTS

| | | | |
|---|---|---|---|
| 0951462 | 8/1982 | U.S.S.R. | 337/407 |

*Primary Examiner*—Z. R. Bilinsky

*Attorney, Agent, or Firm*—Charles Hieken

[57] ABSTRACT

A header has three throughpins supported by glass insulating regions in the header wall having inside and outside portions. A releasable terminal formed with a central opening is soldered to each inside portion of a throughpin and is formed with a groove that carries a lock washer or C-clip that stops a spring in compression stopped at the other end by an epoxy layer adjacent to the inside of the header wall. The assembly is formed by inserting throughpins through the openings, baking the glass insulators at 2000° F., cooling this assembly, soldering the releasable pins to the inside portions at a temperature of substantially 700° F. and allowed to cool. The epoxy layer is then applied at a temperature of the order of 500° F. and then allowed to cool. A coil spring is then inserted over each releasable pin, compressed, a C-clip or lock washer located in the releasable pin groove, and the spring released to engage the C-clip or lock washer while in compression between the epoxy and lock washer or C-clip.

10 Claims, 5 Drawing Figures

PIN RELEASING

The present invention relates in general to pin releasing and more particularly concerns a novel fusible spring-release pin for a hermetic feed-through terminal set that allows safe release when overheating occurs, a not uncommon situation with a hermetically sealed compressor.

Hermetically sealed compressors, such as used in air-conditioning and refrigeration equipment, include headers for hermetically sealing terminals that deliver electrical power to the compressor motor. A problem with these headers is that the compressor unit may overheat and produce such an increase in gas pressure that the pins in the header are propelled outward like a bullet, causing death or injury.

It is an important object of this invention to overcome the problem set forth above.

According to the invention, a header comprises a wall formed with at least one opening through which a conducting throughpin passes insulatedly separated from any other pins, such as by a glass seal around the throughpin. An inside conducting pin formed with an axial opening is seated upon the inside of the throughpin and electrically and mechanically connected thereto by means including meltable conducting material, such as, solder. Spring means urges the inner conducting pin away from the inside of the throughpin so that when the meltable conducting material melts, the inside conducting pin is thrust inward to disconnect the circuit and stop overheating while being safely propelled to the inside of the structure. The inside end of the inside conducting pin may be connected to the compressor motor.

In a specific example of the invention, the inside conducting pin is formed with an annular groove that accommodates a C-clip or lock washer upon which the spring means, comprising a coil spring, bears, the other end of the coil spring bearing against an epoxy layer at the inside of the separating wall.

In the process according to the invention the throughpin (or pins) is inserted through an opening in the header wall and surrounded with glass at the opening baked at high temperature, typically 2000° F. The bored inside conducting pin is soldered to the inside of the throughpin at a lower temperature, typically 700° F. An epoxy layer is added surrounding the inside of the throughpin or pins in the region between the header wall and the inside conducting pin. A coil spring is placed around the inside conducting pin with one end bearing against the epoxy layer. The spring is compressed and a lock washer or C-clip seated in the annular groove and the coil spring allowed to expand until the other end engages the C-clip or lock washer.

Numerous other features, objects and advantages of the invention will become apparent from the following specification when read in connection with the accompanying drawing in which.

Figure 3:
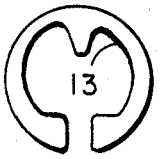
FIG. 3 is a plan view of a C-clip.
Figure 2:
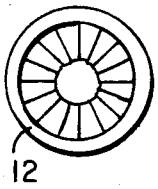
FIG. 2 is a plan view of a lock washer.
Figure 4:
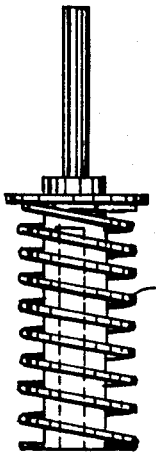
FIG. 4 is a a side view of an inside conducting pin having a coil spring surrounding the hollow end.
Figure 1:
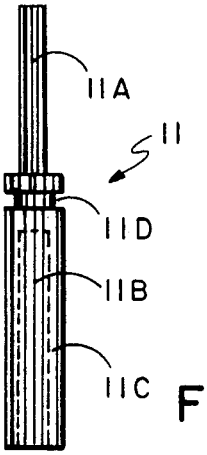
FIG. 1 is a side view of an inside conducting pin.

Referring to FIG. 1, there is shown a plan view partially in section of an inside conducting pin used in the invention. Inside conducting pin 11 is formed with an end terminal 11A, that may be flat or cylindrical, for connection to an internal wire, such as one delivering power to the compressor. The other end is formed with an opening 11B for engaging the inside end of a through terminal and is preferably surrounded by an annular shell 11C, but could be sandwiched between a pair of tines. Pin 11 is also formed with an annular groove 11D for accommodating a C-clip or lock washer. FIG. 2 is a plan view of a lock washer and FIG. 3 is a plan view of a C-clip for being seated in annular groove 11D. FIG. 4 shows the pin of FIG. 1 with the open end surrounded by coil spring 12.

Figure 5:
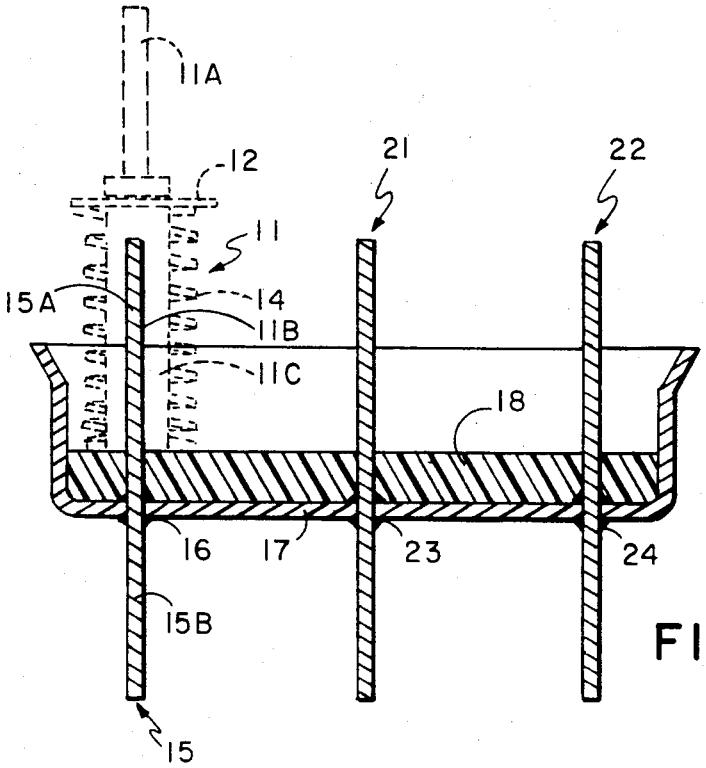
FIG. 5 is an elevation view partially in section of a header according to the invention showing an inside conducting pin seated on the inside end of a throughpin.

Referring to FIG. 5, there is shown an elevation view, partially in section, illustrating a header according to the invention showing pin 11 mounted on one inside portion of the throughpin in dotted outline. Pin 11 is shown soldered to the inside portion 15A of throughpin 15 having a portion 15B on the outside. A hermetic insulating glass seal 16 insulatedly separates throughpin 15 from header wall 17. An epoxy layer 18 extends between the inside of wall 17 and pin 11. FIG. 5 shows second and third throughpins 21 and 22 hermetically insulated from wall 17 by glass seal 23 and 24, respectively. While not shown in FIG. 5 to avoid obscuring the inventive concepts, the inside ends of throughpins 21 and 22 also carry a pin 11 soldered thereto. Wires may then be connected to the ends 11A of each terminal pin 11 by wire wrapping, soldering or other suitable connection techniques.

The method of making the novel header includes inserting the throughpins through openings in wall 17, glass insulating each of the throughpins 15, 21 and 22 with glass and baking at a high temperature of substantially 2000° F. and allowing the assembly to cool so that throughpins 16, 21 and 22 are mechanically supported in wall 17 insulatedly separated therefrom. A pin 11 is then inserted over each inside end of throughpins 16, 21 and 22 and soldered thereto at a lower temperature, typically 700° F. The assembly is allowed to cool, and epoxy layer 18, is added at a temperature of the order to 500° F. The assembly is allowed to cool, and springs 14 are added around each end 11A. While each spring is compressed, a washer 12 or C-clip 13 is inserted into each groove 11D. Each spring 14 is allowed to expand to be confined between a washer 12 or C-clip 13 and epoxy layer 18.

In assembling the header, wires are connected to each end 11A, and the header seated in an opening in the wall of a compressor assembly. Wires are then connected to the outside portions of each through terminal.

If the compressor unit overheats, the solder holding a pin 11 to the inside portion of a throughpin melts, allowing the compressed spring 14 to expand and propel pin 11 off the through terminal and interrupt the flow of power to the compressor motor while all throughpins remain intact in the header. Thus, power is safely interrupted while avoiding propelling a throughpin dangerously outward.

There has been described novel apparatus and techniques for providing a header with throughpins that avoids the danger of propelling throughpins outward when an associated compressor becomes dangerously hot. The structure is relatively inexpensive and easy to fabricate while operating reliably under normal conditions and safely interrupting the circuit when the compressor temperature becomes excessive.

It is evident that those skilled in the art may now make numerous uses and modifications of and departures from the specific apparatus and techniques herein described without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Header apparatus comprising, wall means for supporting throughpins, at least one throughpin having an inside portion and an outside portion, support means for supporting said throughpin in insulatedly separating relationship from said wall means, releasable pin means formed with an opening for engaging said inside portion in conducting relationship, meltable conducting material for electrically and mechanically connecting said releasable pin means to said inside portion, mechanical stop means on said releasable pin means for obstructing expansion of spring means, and spring means interposed between said mechanical stop means and said wall means in compression for propelling said releasable pin means away from said inside portion when said meltable conducting material melts in the presence of an overheated environment in which said header is located.

2. Header apparatus in accordance with claim 1 wherein said releasable pin means is formed with a circumferential annular groove near the portion thereof formed with said opening.

3. Header apparatus in accordance with claim 2 wherein said mechanical stop means comprises a lock washer seated in said circumferential annular groove.

4. Header apparatus in accordance with claim 2 wherein said mechanical stop means comprises a C-clip seated in said circumferential annular groove.

5. Header apparatus in accordance with claim 1 and further comprising a layer of epoxy material adjacent to the inside of said wall means in contact with said spring means.

6. Header apparatus in accordance with claim 1 wherein said support means for supporting said throughpin in insulatedly separated relationship from said wall means comprises a glass seal around said throughpin.

7. Header apparatus in accordance with claim 6 and further comprising a layer of epoxy material adjacent to the inside of said wall means in contact with said spring means.

8. Header apparatus in accordance with claim 7 wherein said mechanical stop means comprises a lock washer seated in said circumferential annular groove.

9. Header apparatus in accordance with claim 7 wherein said mechanical stop means comprises a C-clip seated in said circumferential annular groove.

10. A method of making the header apparatus of claim 1 which method includes the steps of inserting said throughpin through an opening in said wall means surrounded with glass at the opening, baking the glass at high temperature of the order of 2000° F., soldering said releasable pin means to the inside portion of said throughpin at a temperature of the order of 700° F., adding an epoxy layer to the inside of said wall means, placing said spring means around said releasable pin means with one end bearing against said epoxy layer, compressing said spring means, and inserting said mechanical stop means in said circumferential annular groove, and allowing said spring means to expand until the other end thereof engages said mechanical stop means.

* * * * *